US011244652B2

(12) United States Patent
Kim

(10) Patent No.: US 11,244,652 B2
(45) Date of Patent: Feb. 8, 2022

(54) DISPLAY APPARATUS AND CONTROL METHOD THEREOF

(71) Applicant: SAMSUNG ELECTRONICS CO., LTD., Suwon-si (KR)

(72) Inventor: Youngmin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/567,725

(22) Filed: Sep. 11, 2019

(65) Prior Publication Data

US 2020/0098336 A1 Mar. 26, 2020

(30) Foreign Application Priority Data

Sep. 21, 2018 (KR) ..... 10-2018-0113912

(51) Int. Cl.
*G09G 5/10* (2006.01)

(52) U.S. Cl.
CPC ..... *G09G 5/10* (2013.01); *G09G 2320/0626* (2013.01); *G09G 2360/144* (2013.01)

(58) Field of Classification Search
None
See application file for complete search history.

(56) References Cited

U.S. PATENT DOCUMENTS

2010/0253846 A1* 10/2010 Fergason ..... G09G 3/3413 348/576
2014/0176518 A1 6/2014 Min et al.
2016/0098973 A1* 4/2016 Yang ..... G09G 3/3406 345/207
2018/0061313 A1 3/2018 Jang et al.
2019/0191153 A1* 6/2019 Speigle ..... G09G 5/10

FOREIGN PATENT DOCUMENTS

| | | | |
|---|---|---|---|
| ER | 3 346 459 | A1 | 7/2018 |
| JP | 8-250278 | A | 9/1996 |
| JP | 2015-69021 | A | 4/2015 |
| KR | 10-2018-0024526 | A | 3/2018 |
| KR | 10-2018-0052246 | A | 5/2018 |
| WO | 2013/102952 | A1 | 7/2013 |

OTHER PUBLICATIONS

International Search Report and Written Opinion (PCT/ISA/210 and PCT/ISA/237) dated Jan. 16, 2020 issued by the International Searching Authority in counterpart Application No. PCT/KR2019/011951.

* cited by examiner

*Primary Examiner* — Carl Adams
(74) *Attorney, Agent, or Firm* — Sughrue Mion, PLLC

(57) ABSTRACT

A display apparatus includes a display; an optical sensor; and a processor configured to: obtain a current illumination value detected by the optical sensor while the display displays an image, identify a first illumination level corresponding to the obtained current illumination value, the first illumination level being previously obtained at a time when the display is displaying a preset image, identify an ambient brightness based on a second illumination level, the second illumination level corresponding to the identified first illumination level and being previously obtained at a time when the display is not displaying any image, and perform an operation based on the identified ambient brightness.

21 Claims, 12 Drawing Sheets

FIG. 4

400

| AMBIENT BRIGHTNESS (Lux) | DATA DETECTED BY SENSOR | | | | |
|---|---|---|---|---|---|
| | SCREEN OFF | | SCREEN ON | | |
| | ADC0 | ADC1 | ADC0 | ADC1 | DETECTED BRIGHTNESS (Lux) |
| 150 | 2701 | 2451 | 3955 | 2977 | 170 |
| 100 | 1994 | 1789 | 2751 | 2015 | 150 |
| 70 | 1525 | 1352 | 2001 | 1435 | 85 |
| 50 | 1192 | 1055 | 1477 | 1060 | 58 |
| 20 | 605 | 538 | 643 | 587 | 25 |
| ⋮ | ⋮ | ⋮ | ⋮ | ⋮ | ⋮ |

| | | DATA DETECTED BY SENSOR | | | | |
|---|---|---|---|---|---|---|
| | AMBIENT BRIGHTNESS (Lux) | SCREEN OFF | | SCREEN ON | | |
| | | ADC0 | ADC1 | ADC0 | ADC1 | DETECTED BRIGHTNESS (Lux) |
| Case 1 | 150 | 2701 | 2451 | 3955 | 2977 | 170 |
| | 100 | 1994 | 1789 | 2751 | 2015 | 150 |
| Case 2 | 70 | 1525 | 1352 | 2001 | 1435 | 85 |
| | 50 | 1192 | 1055 | 1477 | 1060 | 58 |
| | 20 | 605 | 538 | 643 | 587 | 25 |
| | ⋮ | ⋮ | ⋮ | ⋮ | ⋮ | ⋮ |

DISPLAY APPARATUS AND CONTROL METHOD THEREOF

CROSS-REFERENCE TO RELATED APPLICATION

This application is based on and claims priority under 35 U.S.C. § 119 to Korean Patent Application No. 10-2018-0113912, filed on Sep. 21, 2018, in the Korean Intellectual Property Office, the disclosure of which is incorporated by reference herein in its entirety.

BACKGROUND

1. Field

The disclosure relates to a display apparatus displaying a content image and a control method thereof, and more particularly to a display apparatus, which detects ambient brightness and performs adjustment related to a content image based on the detection results, and a control method thereof.

2. Description of Related Art

To compute and process predetermined information in accordance with certain processes, an electronic apparatus generally includes a central processing unit (CPU), a chipset, a memory, and the like to perform for the computation and the processing. Such an electronic apparatus may be variously classified in accordance with what information will be processed and what it is used for. For example, the electronic apparatus is classified into an information processing apparatus such as a personal computer (PC), a server or the like for processing general information; an image processing apparatus for processing image data; an audio apparatus for an audio process; home appliances for miscellaneous household chores; etc. The image processing apparatus may be a display apparatus that displays processed image data as an image on its own display panel. Examples of a single display apparatus include a television (TV), a monitor, a portable multimedia player, a tablet computer, a mobile phone, etc. As an example of a plurality of display apparatuses, there is a video wall.

The display apparatus may include a sensor to detect changes in various external environmental factors including a user's performance, ambient environmental brightness, noise, etc. The display apparatus not only displays a content image but also performs various operations of the display apparatus, such as adjustment of the content image, based on data detected by the sensor. For example, the display apparatus may detect ambient brightness while a content image is displayed on a screen, and adjust the brightness of the screen based on the detected ambient brightness.

However, the sensor does not distinguish between objects to be detected in terms of detecting the brightness of the surrounding environments. In other words, the sensor detects light from a region where the sensor is placed, but cannot identify what object in the surrounding environments is the source of the light. Therefore, the data detected by the sensor may include data that a user does not want to detect through the sensor, i.e. may mix with noise data. When the display apparatus is provided to perform an operation previously set corresponding to the data detected by the sensor, the presence of such noise data may result in a malfunction of the display apparatus.

Accordingly, it may be required to exclude the noise data and use only the data desired by a user from the data detected by the sensor that detects the ambient environmental factors.

SUMMARY

In accordance with an aspect of the disclosure, a display apparatus includes a display; an optical sensor; and a processor configured to obtain a current illumination value detected by the optical sensor while the display displays an image, identify a first illumination level corresponding to the obtained current illumination value, the first illumination level being previously obtained at a time when the display is displaying a preset image, identify an ambient brightness based on a second illumination level, the second illumination level corresponding to the identified first illumination level and being previously obtained at a time when the display is not displaying any image, and perform an operation based on the identified ambient brightness.

The display apparatus may further include a storage configured to store a table in which a plurality of first illumination levels and a plurality of second illumination levels are tabulated, wherein each first illumination level from among the plurality of first illumination levels and each second illumination level from among the plurality of second illumination levels corresponds to a respective illumination condition from among a plurality of illumination conditions, and wherein the processor identifies the first illumination level and the second illumination level based on the table stored in the storage.

The illumination levels of the table may be based on the illumination values detected by the optical sensor.

The storage may be configured to store a plurality of tables, each table from among the plurality of tables corresponding to a respective image from among a plurality of images that are different in screen brightness, and the processor may identify the ambient brightness based on a table from among the plurality of tables which corresponds to the image displayed by the display.

The storage may be configured to store a plurality of tables, each table from among the plurality of tables corresponding to a respective screen brightness set to the display apparatus, and the processor may identify the ambient brightness based on a table from among the plurality of tables which corresponds to a currently set screen brightness.

While content is being reproduced, the processor may identify a time during which no image is displayed on the display, and identify the ambient brightness based on the illumination value detected by the optical sensor during the identified time.

The processor may identify the time based on metadata of the content.

The processor may be configured to identify a first current illumination level when no image is displayed based on a first illumination value detected by the optical sensor; identify a second current illumination level when the image is displayed based on a second illumination value detected by the optical sensor; compare a first ambient brightness identified based on the first current illumination level with a second ambient brightness identified based on the second current illumination level; identify the first ambient brightness as the ambient brightness based on the first ambient brightness being equal to the second ambient brightness; and identify a third ambient brightness as the ambient brightness based on the first ambient brightness not being equal to the second ambient brightness.

The third ambient brightness may be identified based on the first ambient brightness and the second ambient brightness.

In accordance with an aspect of the disclosure, a method of controlling a display apparatus includes obtaining a current illumination value detected by an optical sensor while a display displays an image; identifying a first illumination level corresponding to the obtained current illumination value, the first illumination level being previously obtained at a time when the display is displaying a preset image; identifying an ambient brightness based on a second illumination level, the second illumination level corresponding to the identified first illumination level and being previously obtained at a time when the display is not displaying any image; and perform an operation based on the identified ambient brightness.

The method may further include storing a table in which a plurality of first illumination levels and a plurality of second illumination levels are tabulated, wherein each first illumination level from among the plurality of first illumination levels and each second illumination level from among the plurality of second illumination levels corresponds to a respective illumination condition from among a plurality of illumination conditions, and wherein the first illumination level and the second illumination level are identified based on the table.

The illumination levels of the table may be based on the illumination values detected by the optical sensor.

The method may further include storing a plurality of tables, each table from among the plurality of tables corresponding to a respective image from among a plurality of images that are different in screen brightness; and identifying the ambient brightness based on the a table from among the plurality of tables which corresponds to the image displayed by the display.

The method may further include storing a plurality of tables, each table from among the plurality of tables corresponding to a respective screen brightness set to the display; and identifying the ambient brightness based on a table from among the plurality of tables which corresponds to a currently set screen brightness.

The method may further include while content is being reproduced, identifying a time during which no image is displayed on the display; and identifying the ambient brightness based on the illumination value detected by the optical sensor during the identified time.

The time may be identified based on metadata of the content.

The method may further include identifying a first current illumination level when no image is displayed based on a first illumination value detected by the optical sensor; identifying a second current illumination level when the image is displayed based on a second illumination value detected by the optical sensor; comparing a first ambient brightness identified based on the first current illumination level with a second ambient brightness identified based on the second current illumination level; identifying the first ambient brightness as the ambient brightness based on the first ambient brightness being equal to the second ambient brightness; and identifying a third ambient brightness as the ambient brightness based on the first ambient brightness not being equal to the second ambient brightness.

The third ambient brightness may be identified based on the first ambient brightness and the second ambient brightness.

In accordance with an aspect of the disclosure, a method for identifying a current ambient brightness in an environment around a display apparatus includes preparing a plurality of ambient illumination conditions; for each ambient illumination condition from among the plurality of ambient illumination conditions, sensing a respective first illumination value at a time when the display apparatus is displaying an image; for each ambient illumination condition from among the plurality of ambient illumination conditions, sensing a respective second illumination value at a time when the display apparatus is not displaying any image; storing a table including the first illumination values in association with the second illumination values according to the plurality of ambient illumination conditions; sensing a first current illumination value at a first current time when the display apparatus is displaying a current image; identifying a first illumination value from among the first illumination values that is equal to the first current illumination value; and identifying the current ambient brightness as a second illumination value from among the second illumination values that is associated with the identified first illumination value.

The method may further include sensing a second current illumination value at a second current time when the display apparatus is not displaying any image; based on the second current illumination value being equal to the second illumination value, identifying the current ambient brightness as the second current illumination value; and based on the second current illumination value not being equal to the second illumination value, identifying the current ambient brightness as a value that is determined based on the second current illumination value and the second illumination value.

The value identified as the current ambient brightness may be an average of the second current illumination value and the second illumination value.

The method may further include preparing a plurality of preset images, each preset image from among the plurality of preset images corresponding to a different respective category of image content; storing a plurality of tables, each table from among the plurality of tables including the first illumination values that are sensed at a time when the display apparatus is displaying a different respective preset image; identifying a current category of image content based on image data of the current image; selecting a table from among the plurality of tables that is stored using a preset image from among the plurality of preset images that corresponds to a category of image content that is equal to the current category of image content; and using the selected table to identify the current ambient brightness.

The method may further include preparing a plurality of preset images, each preset image from among the plurality of preset images having a different respective screen brightness; storing a plurality of tables, each table from among the plurality of tables including the first illumination values that are sensed at a time when the display apparatus is displaying a different respective preset image; identifying a current screen brightness based on image data of the current image; selecting a table from among the plurality of tables that is stored using a preset image from among the plurality of preset images that has a screen brightness equal to the current screen brightness; and using the selected table to identify the current ambient brightness.

In accordance with an aspect of the disclosure, a method for identifying a current ambient brightness in an environment around a display apparatus includes sensing an illumination value at a current time when the display apparatus is not displaying any image; determining the current ambient brightness as the illumination value.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 4 illustrates an example of a table, in which illumination levels obtained at a previous point in time, to be looked up by a display apparatus according to an embodiment;

DETAILED DESCRIPTION

Below, embodiments will be described in detail with reference to accompanying drawings. Further, the embodiments described with reference to the accompanying drawings are not exclusive to each other unless otherwise mentioned, and a plurality of embodiments may be selectively combined within one apparatus. The combination of these plural embodiments may be discretionally selected and applied.

In the description of the embodiments, an ordinal number used in terms such as a first element, a second element, etc. is employed for describing a variety of elements, and the terms are used for distinguishing between one element and another element. Therefore, the meanings of the elements are not limited by the terms, and the terms are also used for explaining the corresponding embodiment without limiting the disclosure.

Further, "at least one" among a plurality of elements in the disclosure represents not only all the elements but also each one of the elements, which excludes the other elements or all combinations of the elements.

Figure 1:
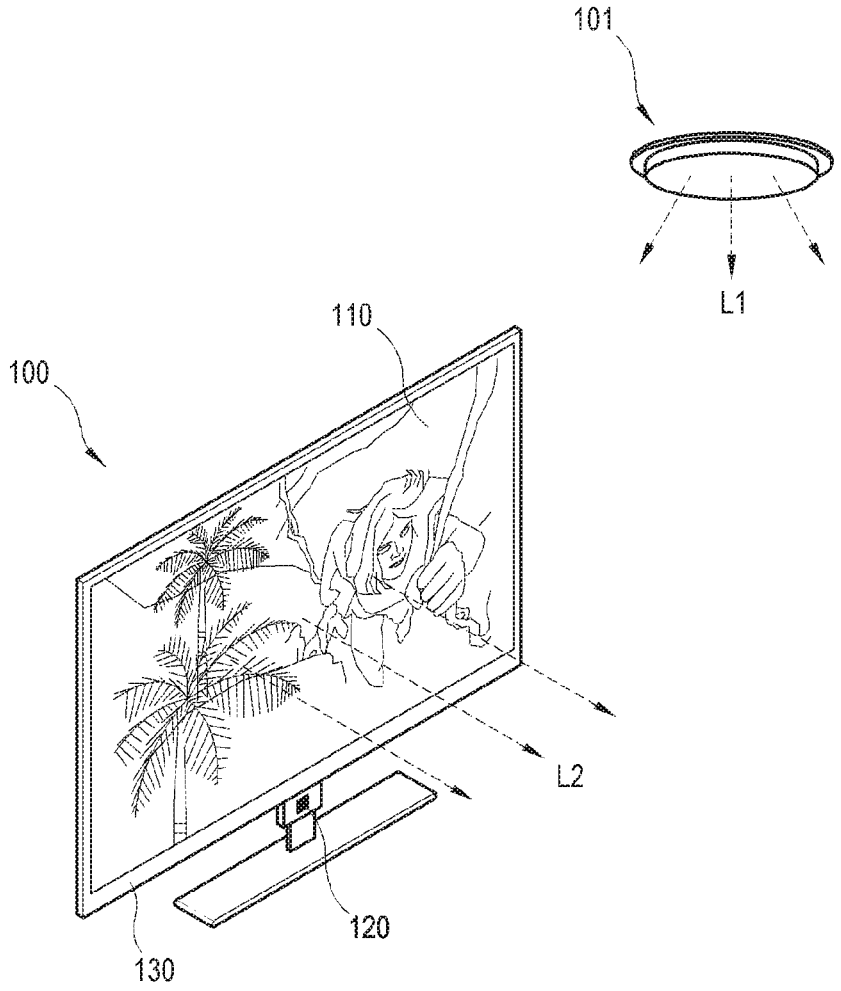
FIG. 1 illustrates a display apparatus according to an embodiment.

FIG. 1 illustrates a display apparatus according to an embodiment.

As shown in FIG. 1, a display apparatus 100 according to an embodiment processes a content image signal based on an image processing process and displays a content image on a display 110. The display apparatus 100 may receive the image signal from a source device and/or obtain the image signal from data stored in a built-in memory of the display apparatus 100. In this embodiment, the display apparatus 100 is a TV as an example, but the display apparatus 100 may be a monitor, a computer, a tablet computer, a digital signage, an electronic frame, a video wall, a portable multimedia player, a mobile phone, a wearable device, or any apparatus capable of displaying an image.

The display apparatus 100 includes a display 110 configured to display an image, and an optical sensor (i.e., a sensor) 120 configured to detect light from an environment around the display apparatus 100. In an embodiment, the sensor 120 may be provided in a lower bezel 130 among bezels 130 supporting the edges of the display 110. However, there are no limits to the position of the sensor 120 in the display apparatus 100.

While a content image is displayed on the display 110, light of a surrounding environment detected by the sensor 120 includes two components as follows. One is a component L1 caused by the surrounding environment, and the other one is a component L2 caused by an image displayed on a display screen of the display 110. The component L1 refers to natural light or light caused by an electric lamp 101, an external apparatus, etc., and includes light generated by sources other than the display apparatus 100. On the other hand, the component L2 refers to light emitted by the display apparatus 100, and includes light output from the display screen.

Thus, data of light detected by the sensor 120 includes both data of the component L1 and the data of component L2. When the display apparatus 100 needs the data detected by the sensor 120 with regard to only the component L1, the data of the component L2 is regarded as noise data and therefore has to be excluded from the detected data. A method by which the display apparatus 100 excludes the data of the component L2 and determines the data of the component L1 from the data detected by the sensor 120 will be described later.

Below, the elements of the display apparatus 100 will be described.

Figure 2:
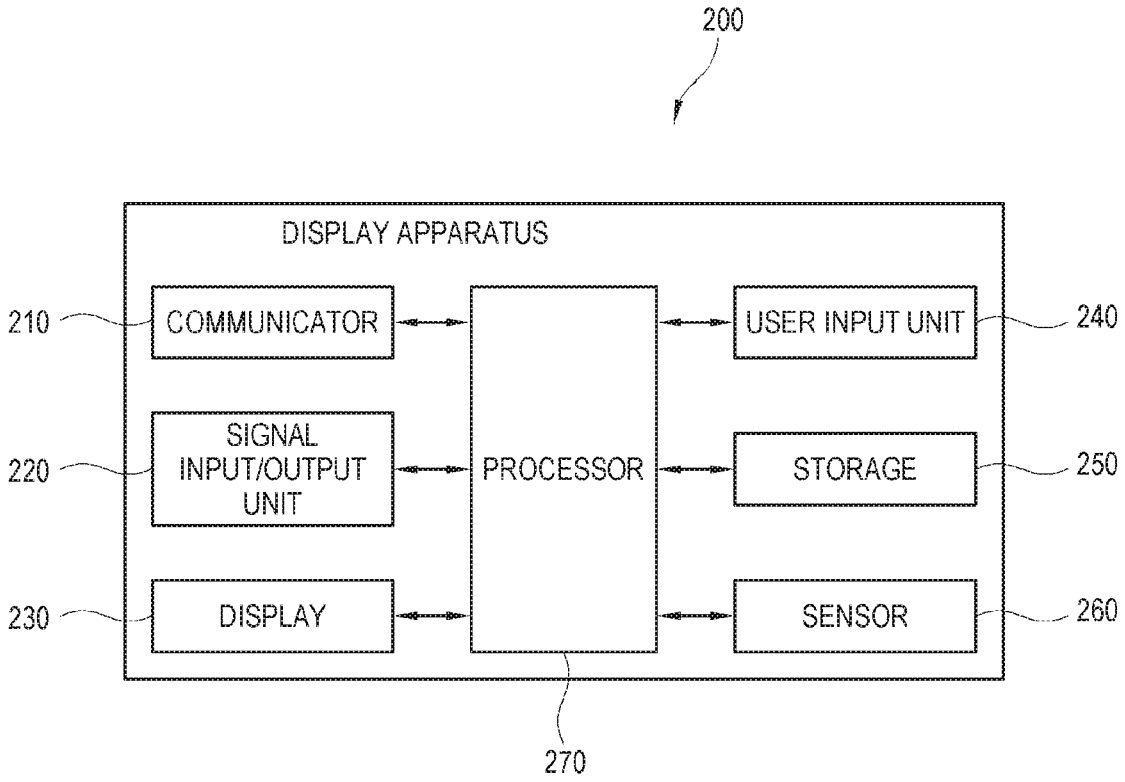
FIG. 2 is a block diagram of a display apparatus according to an embodiment.

FIG. 2 is a block diagram of a display apparatus according to an embodiment.

As shown in FIG. 2, a display apparatus 200 includes a communicator 210 configured to communicate with an external apparatus, a signal input/output unit 220 configured to input/output predetermined data, a display 230 configured to display an image, a user input unit 240 configured to receive a user's input, a storage 250 configured to store data, a sensor 260 configured to detect ambient brightness, and a processor 270 configured to process data.

The communicator 210 refers to an interactive communication circuit that includes at least one of communication modules corresponding to various wired and wireless communication protocols, elements of communication chips, etc. For example, the communicator 210 may include a wireless communication module performing wireless communication with an access point (AP) based on Wi-Fi, or a local area network (LAN) card connected to a router or a gateway by a wire.

The signal input/output unit 220 may be connected to one or more external apparatuses, thereby receiving or outputting data with regard to the corresponding external apparatus. The signal input/output unit 220 may for example include a high definition multimedia interface (HDMI) port, a display port, a universal serial bus (USB) port, and/or any connector or port based on preset protocols.

The display 230 includes a display panel capable of displaying an image on a screen. The display panel is provided to have a light receiving structure such as a liquid crystal type, or a self-emissive structure such as an organic light emitting diode (OLED) type. The display 230 may include an additional element according to the structures of the display panel. For example, when the display panel is the liquid crystal type, there are additionally provided a backlight unit configured to emit light toward a liquid crystal display panel, and a panel driving substrate configured to drive liquid crystal of the liquid crystal display panel, etc.

The user input unit 240 includes various kinds of input interfaces provided to receive a user's input. The user input unit 240 may have various forms according to the kinds of the display apparatus 200, for example, a mechanical or electronic button of the display apparatus 200, a remote controller separated from the display apparatus 200, a touch pad, a touch screen provided in the display 230, etc.

The storage 250 is accessed by the processor 270, and performs operations such as reading, recording, modifying, deleting, etc. for data under control of the processor 270. The storage 250 includes a flash memory, a hard disk drive (HDD), a solid state drive (SSD), and/or any nonvolatile memory in which data is retained regardless of whether power is supplied or not; and a buffer, a random access memory (RAM) and/or any volatile memory to which processing data is loaded.

The sensor 260 detects light from the surrounding environment, and outputs data corresponding to the detected light to the processor 270. In an embodiment, the sensor 260 may be an illumination sensor, a photo sensor, an optical sensor, etc. Such detected data corresponds to the quantity of light detected by the sensor 260, and may be expressed quantitatively. The sensor 260 may include one or more detection channels for detecting light. When there is a plurality of detection channels, the sensor 260 may output an illumination level calculated based on an illumination value corresponding to each detection channel.

The processor 270 processes content data received through the communicator 210 or the signal input/output unit 220. When the content data has attributes of image content, the processor 270 makes the display 230 display an image based on the content data. The processor 270 includes one or more hardware processors implemented by a central processing unit (CPU), a chipset, a buffer, a circuit, etc., which are mounted on a printed circuit board, and may be designed as a system on chip (SoC). The processor 270 may include a demultiplexer, a decoder, a scaler, an audio digital signal processor (DSP), an amplifier, etc., and some or all of them may be achieved in the form of the SoC. For example, a demultiplexer, a decoder, a scaler, and/or any module related to an image process may be implemented by an image processing SoC, and an audio DSP may be implemented by a chipset separate from the SoC.

The processor 270 analyzes an illumination level received from the sensor 260, and identifies ambient brightness, from which noise components caused by the screen brightness of the display 230 are excluded, based on the illumination level. The processor 270 performs a preset operation corresponding to the identified ambient brightness. There may be various preset operations, for example, adjustment of screen brightness. The processor 270 increases the screen brightness as the identified ambient brightness becomes higher, and decreases the screen brightness as the identified ambient brightness becomes lower. As one of methods for the adjustment, the processor 270 may look up a table where screen brightness is tabulated corresponding to the ambient brightness.

There may be various methods by which the processor 270 identifies the ambient brightness from which noise components caused by the screen brightness are excluded from an illumination level detected by the sensor 260. Below, embodiments of such methods will be described.

Figure 3:
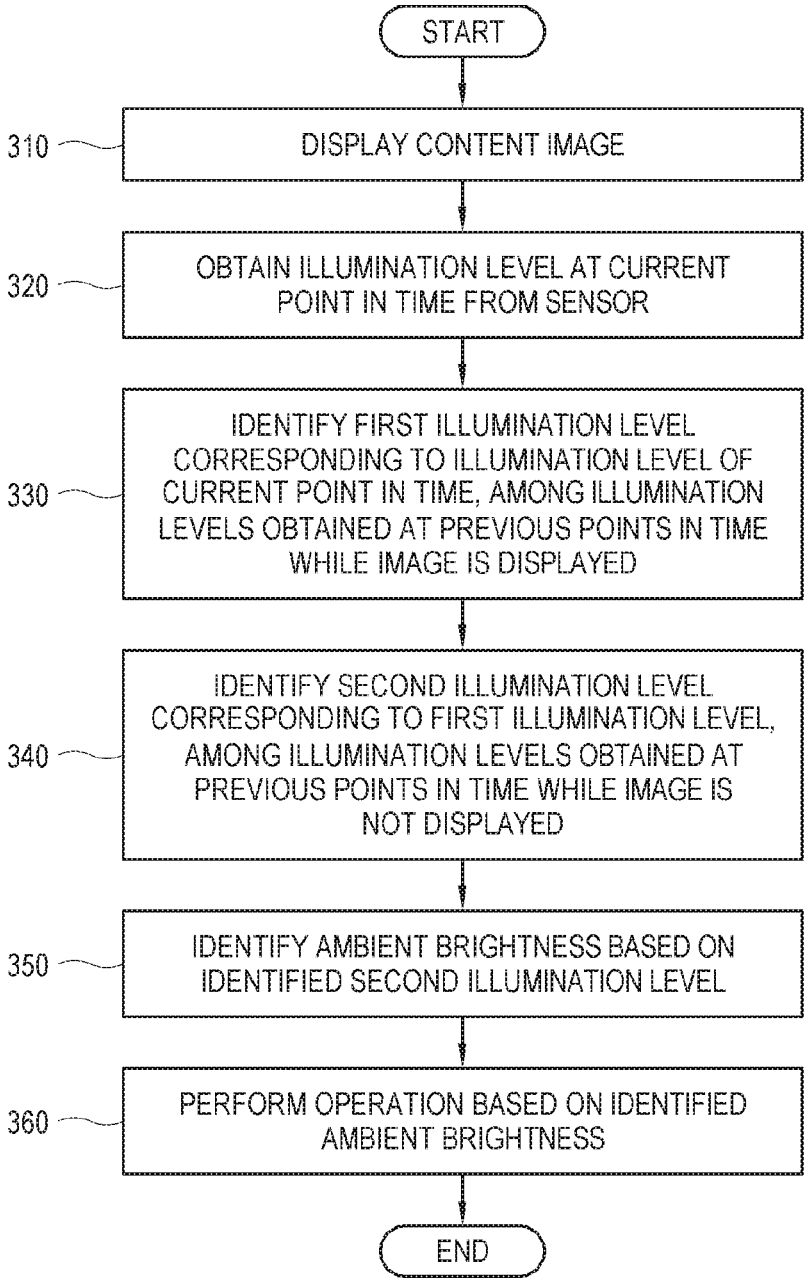
FIG. 3 is a flowchart showing a control method of a display apparatus according to an embodiment.

FIG. 3 is a flowchart showing a control method of a display apparatus according to an embodiment.

The embodiment shown in FIG. 3 may be implemented by the processor of the display apparatus.

At operation 310, the display apparatus displays a content image.

At operation 320, the display apparatus obtains an illumination level at a current point in time from a sensor that detects ambient light.

At operation 330, the display apparatus calls for values of the illumination levels obtained at previous points in time while displaying an image, and identifies a first illumination level corresponding to the illumination level of the current point in time among the called values.

At operation 340, the display apparatus calls for values of the illumination levels obtained at previous points in time while displaying no images, and identifies a second illumination level corresponding to the first illumination level among the called values. Such called values may for example be stored as a table in the display apparatus, and detailed descriptions in this regard will be made later.

At operation 350, the display apparatus identifies the ambient brightness based on the identified second illumination level.

At operation 360, the display apparatus performs a preset operation based on the identified ambient brightness.

Therefore, the display apparatus according to an embodiment excludes noise components caused by the screen brightness and determines only the ambient brightness from the illumination level of the sensor that detects light. Thus, the ambient brightness is more accurately determined based on illumination levels with a displayed image and illumination levels with no displayed images obtained at previous points in time, so that operation to be implemented corresponding to the ambient brightness can be more correctly performed in the display apparatus.

As described in the foregoing operation, the illumination levels with a displayed image and illumination levels with no displayed images obtained at previous points in time may for example be stored in the display apparatus as a table to be easily retrieved. Below, an example of the table where the illumination levels obtained at the previous points in time are tabulated will be described.

FIG. 4 illustrates an example of a table, in which illumination levels obtained at previous points in time are stored, to be looked up by a display apparatus according to an embodiment.

As shown in FIG. 4, a table 400 shows illumination values and illumination levels measured under various environments at previous points in time. The display apparatus may draw the ambient brightness at a current point in time while looking up the table 400, based on the illumination level detected by the sensor measured at the current point in time.

The foregoing previous point in time may include any points in time prior to the current point in time. For example, the table 400 may be produced in a manufacturing stage of a display apparatus and stored in the display apparatus. In this case, the table 400 is produced using a test-purpose display apparatus of the same model or environment as the display apparatus according to an embodiment, and the produced table 400 is stored in the display apparatus according to this embodiment. The sensor used in producing the table 400 is different from but has substantially the same function as the sensor of the display apparatus according to this embodiment.

Alternatively, the table 400 may be stored in a server, an external memory, or the like, or the display apparatus may store the table 400 after receiving it through network communication, local communication, etc.

Alternatively, the table 400 may be produced or modified at a specific process such as an initial setting stage during the operation of the display apparatus. Here, the initial setting stage refers to a process to be executed for setting use environments of the display apparatus when the display apparatus is initially powered on. Alternatively, the process for producing or modifying the table 400 may start in response to a preset user's input. In this case, the sensor used in producing or modifying the table 400 is the sensor of the display apparatus according to this embodiment.

The table 400 stores brightness levels detected at previous points in time, and ambient brightness levels corresponding to the detected brightness levels. Here, the detected brightness level refers to the first illumination level of the foregoing embodiment, and the ambient brightness level refers to the second illumination level of the foregoing embodiment. To make description of this embodiment simple and clear, the table 400 involves only some values as compared with those of a practical table.

In the table 400, data detected by the sensor includes two kinds of data, i.e. data detected when a screen is on, and data detected when the screen is off. The former shows a detection result of the sensor while a preset image is displayed on the screen, and the latter shows a detection result of the sensor while no images are displayed on the screen, i.e. when the screen is off or when an image having a solid color, i.e. black is displayed on the screen. Here, the foregoing preset image refers to an image prepared for producing the table 400, and there are no limits to the content of the image. For convenience, this image will be called a standard image.

Below, items of the table 400 according to an embodiment will be described.

In the data detected by the sensor, items in the "SCREEN OFF" columns are illumination values detected by the sensor while the standard image is not displayed on the screen. For example, when the sensor has two detection channels of ADC0 and ADC1, the sensor outputs two illumination values through the respective channels. Meanwhile, items in the "SCREEN ON" columns are illumination values detected by the sensor while the standard image is displayed on the screen. In this case, the sensor outputs two illumination values of ADC0 and ADC1. In this embodiment, there are no limits to the number of channels. Such detection is performed for one or more values of ambient brightness, and therefore data detected when the screen is off and when the standard image is displayed are collected according to the ambient brightness.

From the collected detection data, the brightness detected by the sensor when the screen is on is determined. For example, when ADC0 has an illumination value of 3955 and ADC1 has an illumination value of 2977 when the screen is on, the brightness detected by the sensor when the screen is on is determined as an illumination level of '170' lux by a preset function using ADC0 and ADC1. Likewise, when ADC0 has an illumination value of 1477 and ADC1 has an illumination value of 1060 when the screen is on, the brightness detected by the sensor when the screen is on is determined as an illumination level of '58' lux. The function may be derived based on various experiments and theories, and thus is not restricted to a specific expression.

Screen brightness is not substantially present when the screen is off, and it is thus expected that noise components caused by the screen brightness are not substantially involved. Therefore, the ambient brightness from which the noise components are excluded may be determined from the illumination values of ADC0 and ADC1 when the screen is off. For example, when ADC0 has an illumination value of 2701 and ADC1 has an illumination value of 2451 when the screen is off, the ambient brightness from which the noise components are excluded is determined as an illumination level of '150' lux by the preset function using ADC0 and ADC1. The function may be derived based on various experiments and theories, and thus is not restricted to a specific expression.

The data detected by the sensor is collected with regard to the respective cases where the screen of the standard image is off and under the condition that the ambient brightness has a predetermined first value, and the first illumination level and the second illumination level are determined based on the collected data. Here, the first illumination level indicates the brightness detected by the sensor when the screen is on involving both the screen brightness and the ambient brightness, and the second illumination level indicates the brightness detected by the sensor when the screen is off excluding the screen brightness and involving only the ambient brightness. The first illumination level and the second illumination level are regarded as corresponding to each other because they are determined under the conditions of the same ambient brightness.

The table 400 may be produced by the test-purpose display apparatus for the table 400 or the display apparatus according to an embodiment.

Below, a method of ultimately determining the current ambient brightness from the table 400 will be described with reference to the foregoing operation of FIG. 3.

The display apparatus calls for the illumination levels obtained at previous points in time while an image is displayed, and identifies the first illumination level corresponding to the illumination level of the current point in time among the called values. For example, when the illumination level detected by the sensor at the current point in time is '85' lux, the display apparatus selects 85 lux corresponding to the illumination level of the current point in time among the values of the detected brightness item on the table 400.

The value exactly corresponding to the illumination level of the current point in time may not be present on the table 400. For example, the illumination level of the current point in time may be '100' lux. While '85' lux and '150' lux are given as the detected brightness items in the table 400, '100' lux is not given as an item in the table 400. In such a case, '85' lux, which more approximates to the illumination level '100' of the current point in time, may be selected among the items of the table 400.

Next, the display apparatus calls for the illumination levels obtained at previous points in time while an image is not displayed, and identifies the second illumination level corresponding to the first illumination level among the called values. For example, when the illumination level of the detected brightness selected on the table 400 is '85' lux, the display apparatus may determine '70' lux, i.e. the illumination level of the ambient brightness corresponding to the illumination level of the corresponding detected brightness from the table 400.

In this way, the display apparatus may employ the table 400 to determine the ambient brightness, from which the noise components are excluded, from the illumination level currently detected by the sensor.

Below, another embodiment of a method, by which the display apparatus identifies the ambient brightness, from which the noise components caused by the screen brightness are excluded, from the illumination level of the sensor, will be described.

Figure 5:
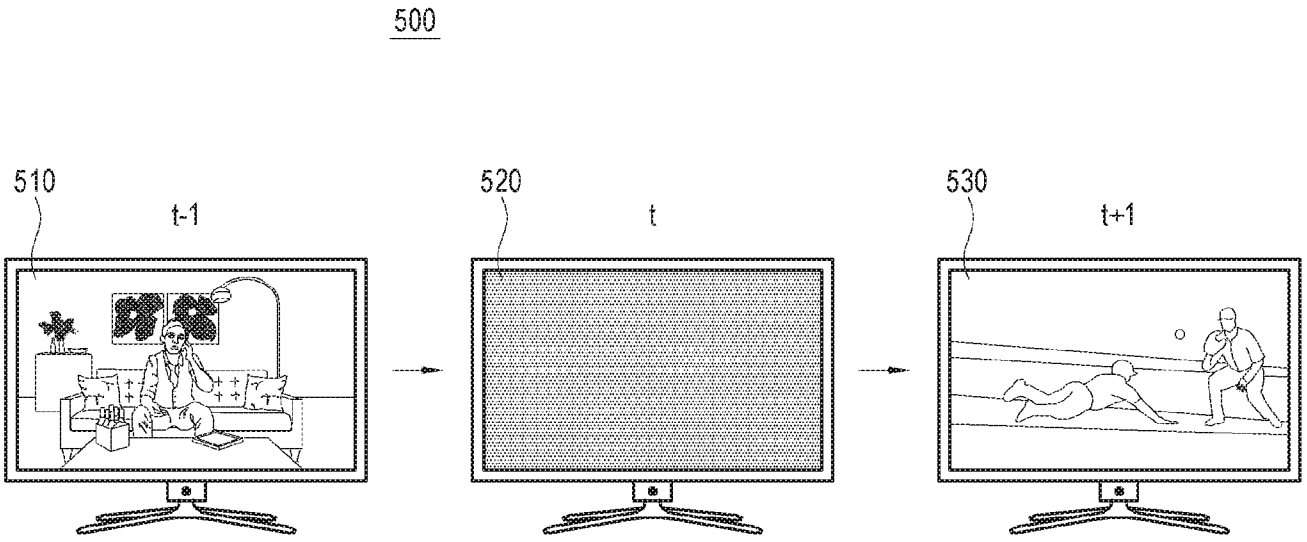
FIG. 5 illustrates an example of displaying a content image and a black screen in a display apparatus according to an embodiment.

FIG. 5 illustrates an example of displaying a content image and a black screen in a display apparatus according to an embodiment.

As shown in FIG. 5, a display apparatus 500 may display content images 510 and 530 by reproducing content. The reproduction of the content is divided into two sections (i.e., times). One is a content display section where images 510 and 530 are actually displayed, and the other one is a black screen section where only a solid black color 520 is displayed without displaying an image. The solid black color 520 may be displayed, for example, when content or a channel is switched or when a scene in content is changed.

In the example of FIG. 5, the points in time (t−1), t, (t+1) are continuous time, the points in time (t−1) and (t+1) correspond to the content display section, and the point in time t corresponds to the black screen section.

In the black screen section, the screen brightness is substantially zero. Therefore, in the black screen section, the noise components caused by the brightness of the screen are not substantially included in the illumination level detected by the sensor. In other words, it is expected that the illumination level detected by the sensor, which is obtained in the black screen section, is caused by the ambient brightness from which the noise components are removed. On the other hand, the illumination level detected by the sensor in the content display section includes the noise components caused by the screen brightness.

Thus, the display apparatus identifies the black screen section while reproducing the content, and identifies the ambient brightness based on the illumination level detected by the sensor in the identified black screen section (i.e., at the time that the black screen is displayed).

Various methods may be used to identify which reproduction section is the black screen section while reproducing the content. For example, a content signal includes content data and metadata. The metadata includes various pieces of information about the content data. For example, the metadata may include information indicating whether a reproduction section or an image frame corresponds to the black screen section according to reproduction sections or image frames. The display apparatus 500 may identify whether a currently reproducing section is the black screen section, with reference to the metadata while reproducing the content.

Below, operation of identifying ambient brightness by the display apparatus 500 according to this embodiment will be described.

Figure 6:
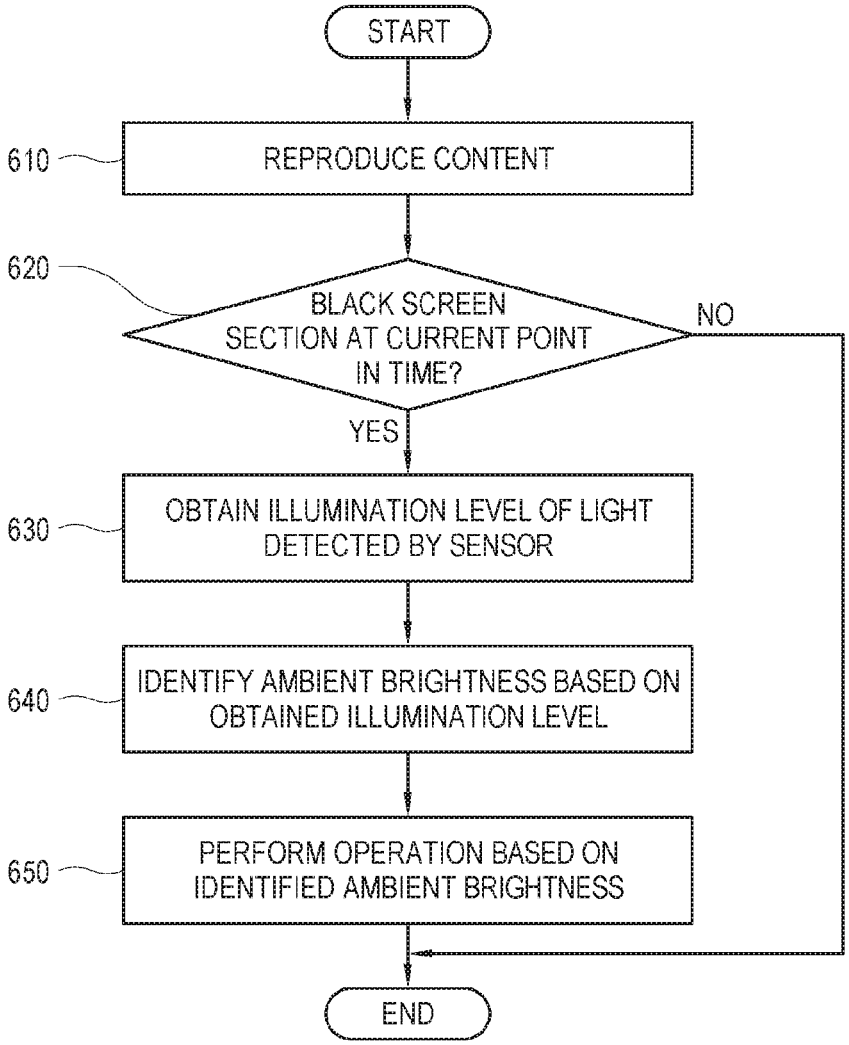
FIG. 6 is a flowchart showing another method by which a display apparatus according to an embodiment identifies ambient brightness while displaying a content image.

FIG. 6 is a flowchart showing another method by which a display apparatus according to an embodiment identifies ambient brightness while displaying a content image.

The embodiment shown in FIG. 6 may be performed by the processor of the display apparatus.

At operation 610 the display apparatus reproduces content to be displayed as a content image.

At operation 620 the display apparatus identifies whether the current point in time corresponds to the black screen section. When the current point in time does not correspond to the black screen section, the reproduction of the content is maintained without any special additional operation.

On the other hand, when the current point in time corresponds to the black screen section, at operation 630 the display apparatus obtains the illumination level of the light detected by the sensor.

At operation 640 the display apparatus identifies the ambient brightness based on the illumination level obtained by the sensor.

At operation 650 the display apparatus performs a preset operation based on the identified ambient brightness.

Unlike the foregoing embodiment, the display apparatus in this embodiment may determine the ambient brightness without using a previously prepared table.

In some cases, it may be identified that the reliability of the ambient brightness determined during the black screen section according to an embodiment is low, or further verification may be needed. For example, when the duration of the black screen section is shorter than a predetermined threshold value, i.e. when the black screen section is relatively too short, it may be regarded that verification of the ambient brightness is required.

There are many methods of verifying the ambient brightness determined during the black screen section, and one exemplary method is to use the foregoing table according to an embodiment. Below, such an embodiment in this regard will be described.

Figure 7:
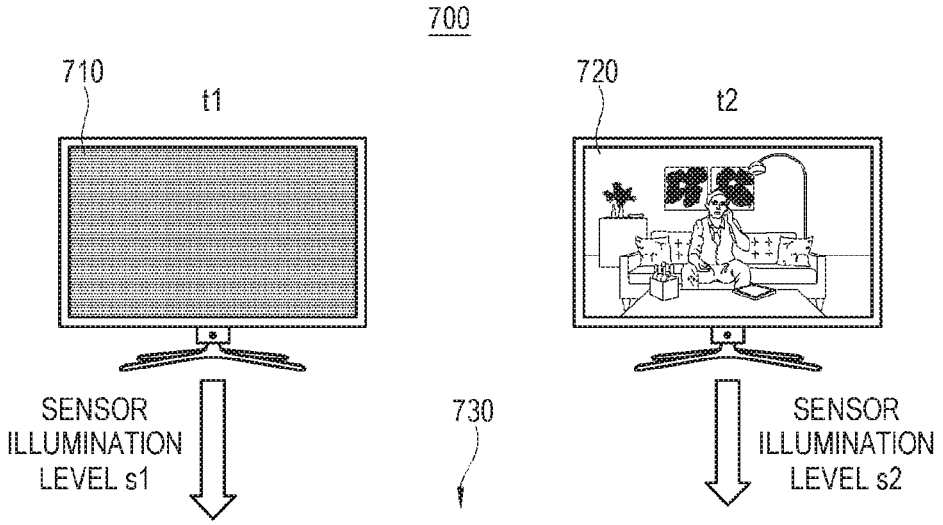
FIG. 7 illustrates an example that a display apparatus according to an embodiment verifies an illumination level, which is detected by a sensor during a black screen section, based on a table.

FIG. 7 illustrates an example by which a display apparatus according to an embodiment verifies an illumination level, which is detected by a sensor during a black screen section, based on a table.

As shown in FIG. 7, a display apparatus 700 obtains an illumination level s1 detected by a sensor in the black screen section where a black screen 710 is displayed at a predetermined point in time t1 while a content image is reproduced. Because the illumination level s1 is detected in the black screen section, it is expected that the illumination level s1 involves only the ambient brightness and excludes the screen brightness. The foregoing process is equivalent to that described in a foregoing embodiment.

However, when it is regarded that the black screen section is relatively too short and thus the reliability of the illumination level s1 is low, or when there is a need of determining a highly accurate result value even though the black screen section is not relatively short, a method of verifying the illumination level s1 may be required. In this case, the display apparatus 700 may use a previously stored table 730 to verify the illumination level s1. The method of producing the table 730 is equivalent to that described in a foregoing embodiment.

The display apparatus 700 obtains the illumination level s2 detected by the sensor in a section where a content image 720 is displayed at a predetermined point in time t2. Here, the points in time t1 and t2 are close to each other. For example, the point in time t2 may be set within a time range in seconds immediately after the black screen section, which includes the point in time t1, is terminated. Further, the point in time t1 does not always precede the point in time t2. Alternatively, the point in time t2 may precede the point in time t1. The order of the points in time t1 and t2 is not limited so long as they are present within the time range during which the ambient brightness is not varied.

The display apparatus 700 retrieves values corresponding to the illumination levels s1 and s2 from the table 730. The display apparatus 700 searches for the value corresponding to the illumination level s1 among the ambient brightness values stored in the table. The display apparatus 700 also searches for the value corresponding to the illumination level s2 among the detected brightness values stored in the table. Because the illumination level s1 is the value excluding the noise components caused by the screen brightness, one of the ambient brightness values is directly retrieved from the table 730. Because the illumination level s2 is the value including the noise components caused by the screen brightness, one of the detection brightness values is first retrieved from the table 730 and the corresponding ambient brightness value is then retrieved.

There are two cases of retrieval results: the first case is that the two ambient brightness values retrieved from the table 730 are the same, and the second case is that the two values retrieved from the table 730 are different.

Below, an example of the first case will be described. For example, among the values of the table 730, the ambient brightness corresponding to the illumination level s1 has an illumination level of '150' lux, and the detected brightness corresponding to the illumination level s2 has an illumination level of '170' lux. The ambient brightness matching '170' lux has the illumination level of '150' lux. In other words, when the illumination levels of the ambient brightness on the table 730 respectively corresponding to the illumination levels s1 and s2 are equal as '150' lux, it may be regarded that the illumination level s1 is a reliable value. Thus, the display apparatus 700 identifies the illumination level s1 as the ambient brightness.

Below, an example of the second case will be described. For example, among the values of the table 730, the ambient brightness corresponding to the illumination level s1 has an illumination level of '70' lux, and the detected brightness corresponding to the illumination level s2 has an illumination level of '58' lux. The ambient brightness matching '58' lux has the illumination level of '50' lux. While the ambient brightness on the table 730 corresponding to the illumination level s1 has an illumination level of '70' lux, the ambient brightness on the table 730 corresponding to the illumination level s2 has an illumination level of '50' lux. That is, the illumination levels of the ambient brightness on the table 730 respectively corresponding to the illumination levels s1 and s2 are different.

When the illumination levels of the ambient brightness on the table 730 respectively corresponding to the illumination levels s1 and s2 are not equal, it is regarded that the reliability of the illumination level s1 is low. Thus, the display apparatus 700 identifies the ambient brightness by determining a new value based on the ambient brightnesses in the table 730 respectively corresponding to the illumination levels s1 and s2

For example, the illumination level of the ambient brightness (i.e., a first ambient brightness) corresponding to the illumination level s1 on the table 730 is '70' lux, and the illumination level of the ambient brightness (i.e., a second ambient brightness) corresponding to the illumination level s2 on the table 730 is '50' lux. The display apparatus 700 identifies an average value of '60' lux between these two values as the ambient brightness (i.e., a third ambient brightness). Besides the average value between these two values, various mathematical methods may be used to determine a new value.

In this way, the display apparatus 700 may identify the ambient brightness at a current point in time, based on the table 730 and the illumination level of the sensor in the black screen section.

Below, operation of the display apparatus 700 according to an embodiment to identify the ambient brightness will be described.

Figure 8:
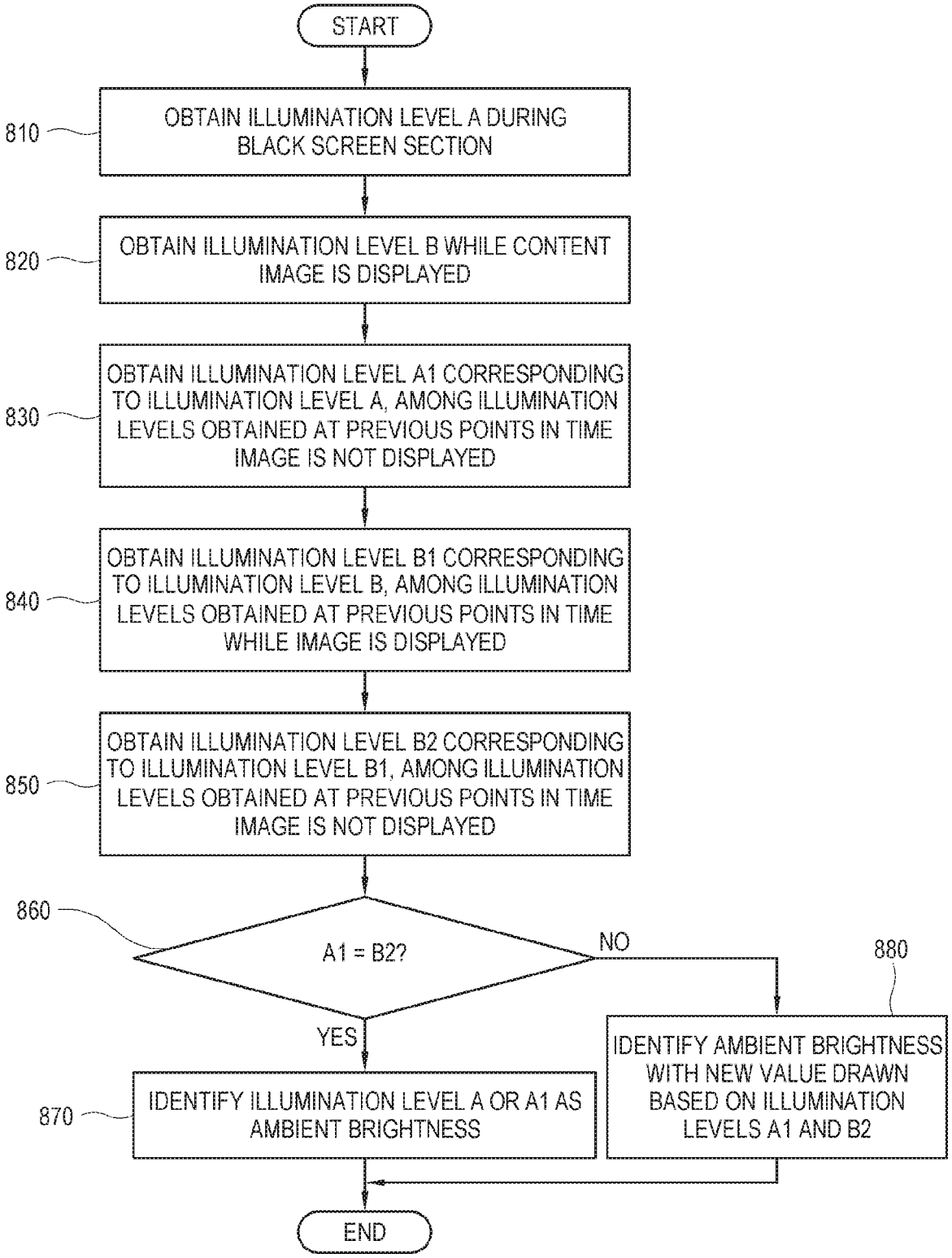
FIG. 8 illustrates a flowchart showing a method by which a display apparatus according to an embodiment identifies ambient brightness based on a table and an illumination level detected by a sensor during a black screen section.

FIG. 8 illustrates a flowchart showing a method by which a display apparatus according to an embodiment identifies ambient brightness based on a table and an illumination level detected by a sensor during a black screen section.

The embodiment shown in FIG. 8 may be implemented by the processor of the display apparatus.

At operation 810 the display apparatus obtains an illumination level A detected by the sensor in the black screen section where the image is not displayed, while reproducing content to display a content image.

At operation 820 the display apparatus obtains an illumination level B detected by the sensor, while displaying the content image.

At operation 830 the display apparatus obtains an illumination level A1 corresponding to the illumination level A, among the illumination levels obtained at previous points in time while no images are displayed.

At operation 840 the display apparatus obtains an illumination level B1 corresponding to the illumination level B, among the illumination levels obtained at the previous points in time while an image is displayed. In this operation, the illumination levels, which are obtained at the previous points in time at which no images are displayed and at which an image is displayed, are tabulated like the table described in the foregoing embodiments.

At operation 850 the display apparatus obtains an illumination level B2 corresponding to the illumination level. The illumination level B2 is obtained from among the illumination levels obtained at the previous points in time while no images are displayed.

At operation 860 the display apparatus identifies whether the value A1 is equal to the value B2.

When the values A1 and B2 are equal, at operation 870 the display apparatus identifies the illumination level A or A1 as the ambient brightness.

On the other hand, when the values A1 and B2 are different, at operation 880 the display apparatus identifies the ambient brightness as a new value determined based on the values A1 and B2.

With this method, the display apparatus may determine the ambient brightness.

In the foregoing embodiment, the standard image is used when the table is generated. The standard image may include any image. However, when a relationship between the noise component included in the illumination level detected by the sensor at the current point in time and the standard image is taken into account while the display apparatus uses the table to determine the ambient brightness, an additional separate embodiment in this regard is possible.

According to the foregoing embodiment, a predetermined standard image is used to produce a table where the illumination levels, which are obtained at the previous points in time at which no images are displayed and at which an image is displayed, are tabulated. Therefore, such a table reflects the screen brightness caused by the standard image in the noise components. This means that the noise components are varied and the values tabulated as the table are also varied depending on what content is used as the standard image.

In a case where one table based on one standard image is used, when the screen brightness of the content image displayed at the current point in time is similar to the screen brightness of the standard image, the accuracy of the ambient brightness determined based on the table is relatively high. On the other hand, when the screen brightness of the content image displayed at the current point in time is very different from the screen brightness of the standard image, the accuracy of the ambient brightness determined based on the table is relatively low.

In this respect, the tables are individually provided according to a plurality of standard images having different screen brightnesses, and a table based on a standard image having similar screen brightness to a currently displayed content image is selectively usable. Below, such an embodiment will be described.

Figure 9:
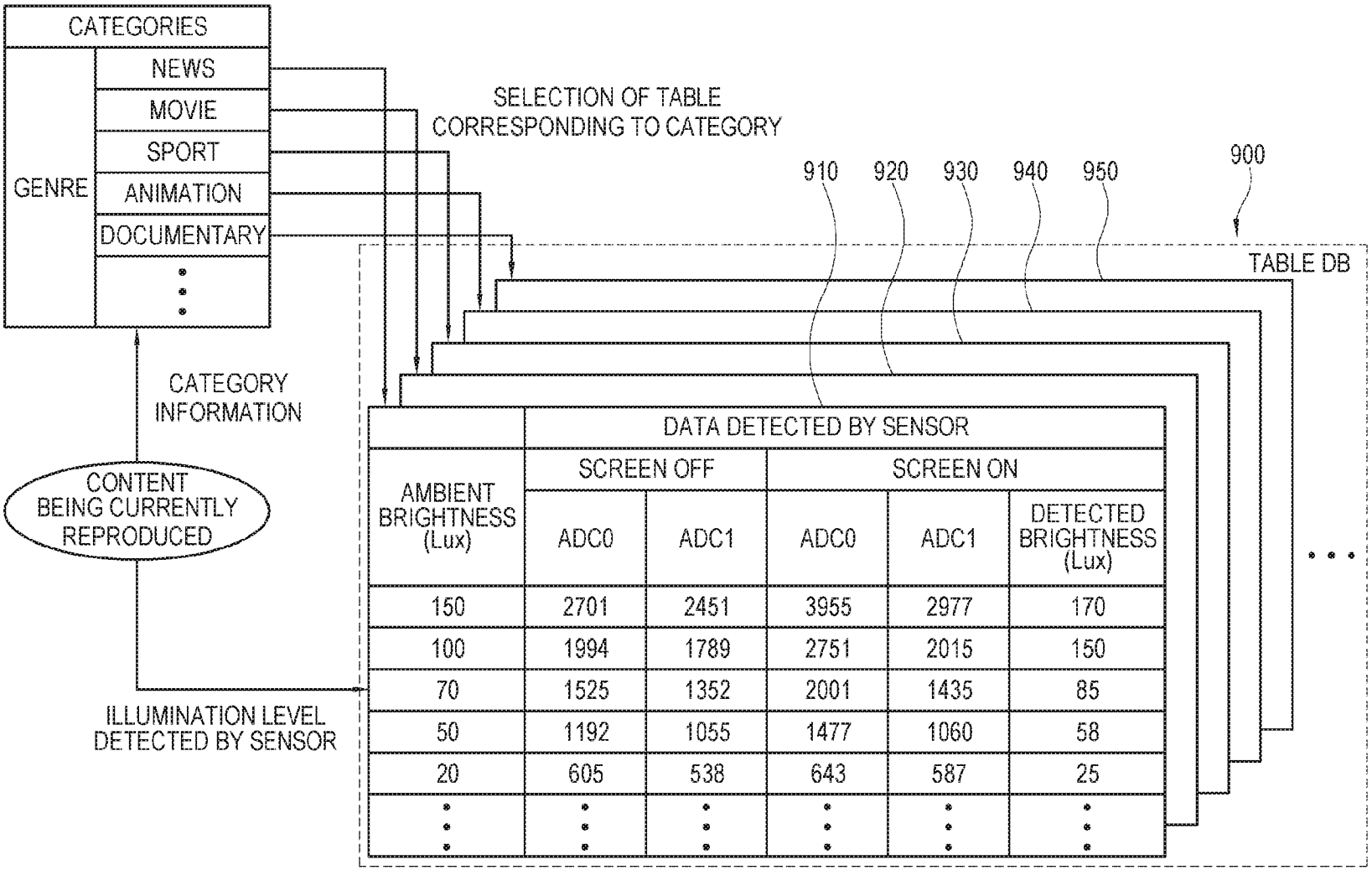
FIG. 9 illustrates an example of a principle that a display apparatus according to an embodiment identifies ambient brightness based on a table according to categories of content.

FIG. 9 illustrates an example of a principle that a display apparatus according to an embodiment identifies ambient brightness based on a table according to categories of content.

As shown in FIG. 9, the display apparatus includes a table database (DB) 900 including a plurality of tables 910, 920, 930, 940 and 950. Unlike the single table according to the foregoing embodiment, the plurality of tables 910, 920, 930, 940 and 950 according to this embodiment are provided such that each table corresponds to a different category of displayed content.

The content may belong to one of the plurality of categories. There may be various categories in accordance with the criteria used to sort the content. In this embodiment, the content may for example be categorized into news, movies, sports, animations, documentaries, etc. (i.e., according to the genre of the content). Based on such content categories, the table DB 900 includes a table 910 corresponding to a news category, a table 920 corresponding to a movie category, a table 930 corresponding to a sport category, a table 940 corresponding to an animation category, a table 950 corresponding to a documentary category, etc.

The criteria for categorizing the content is not limited to the genre. For example, the content may be categorized into first to fifth levels of the screen brightness, and the tables 910, 920, 930, 940 and 950 may be produced based on the standard images corresponding to the respective levels. Each of the tables 910, 920, 930, 940 and 950 is produced based on the standard image of the corresponding category. The standard images may be chosen based on any criteria of the category. For example, the standard images for the tables 910, 920, 930, 940 and 950 may be different in screen brightness from one another.

In other words, the plurality of tables 910, 920, 930, 940 and 950 are prepared based on the standard images different in the screen brightness, and the content is sorted into the categories corresponding to the standard images. The display apparatus identifies which category the current content belongs to, and identifies the ambient brightness by selecting one of the tables 910, 920, 930, 940 and 950 corresponding to the identified category. The method of producing the tables 910, 920, 930, 940 and 950, and the method of identifying the ambient brightness based on the tables 910, 920, 930, 940 and 950 are equivalent to those described in a foregoing embodiment.

For example, the display apparatus identifies the genre of the content based on metadata of currently reproducing content. The display apparatus selects the table 910 corresponding to the news category among the plurality of tables 910, 920, 930, 940 and 950 when the identified genre is the news, and selects the table 950 corresponding to the documentary category when the identified genre is the documentary. The display apparatus identifies the ambient brightness based on the illumination level detected by the sensor at a current point in time, and such a selected table among the tables 910, 920, 930, 940 and 950.

Below, the operation of identifying the ambient brightness by the display apparatus according to an embodiment will be described.

Figure 10:
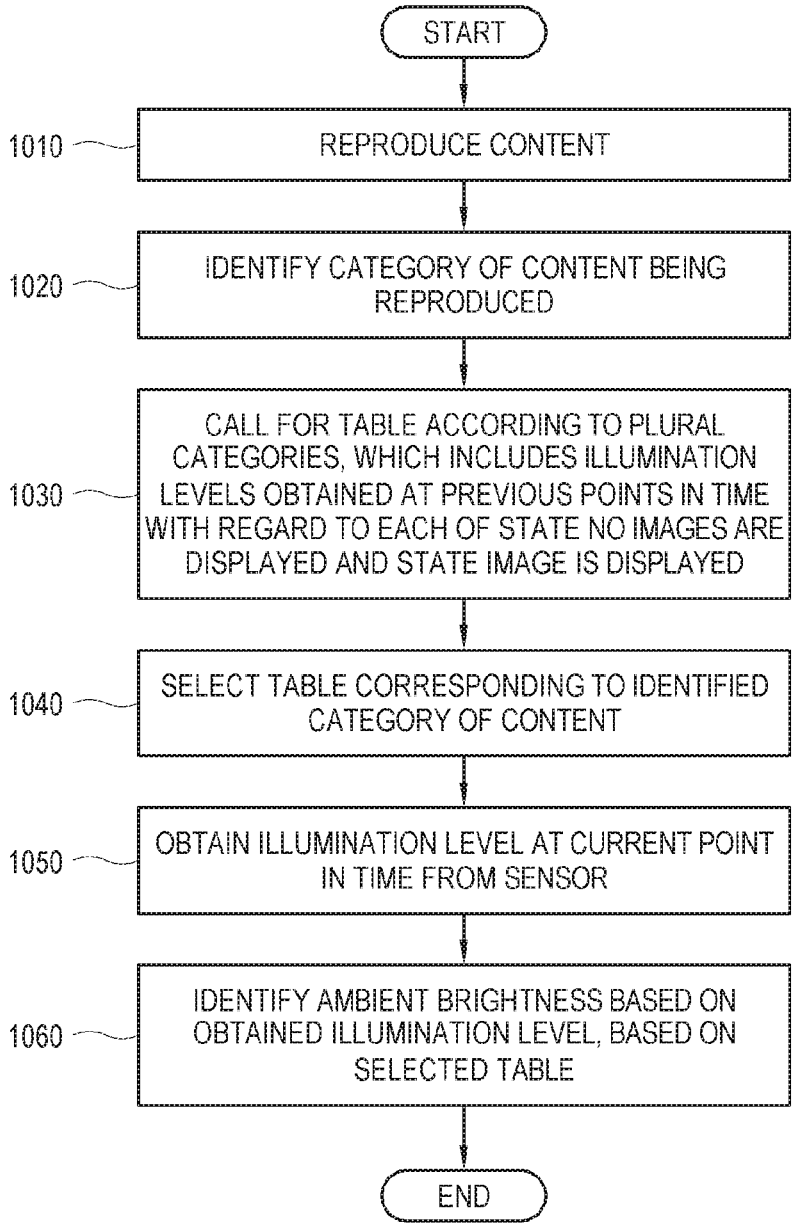
FIG. 10 is a flowchart showing a method by which a display apparatus according to an embodiment identifies ambient brightness based on a table according to categories.

FIG. 10 is a flowchart showing a method by which a display apparatus according to an embodiment identifies ambient brightness based on a table selected according to the category of displayed content.

The embodiment shown in FIG. 10 may be implemented by the processor of the display apparatus.

At operation 1010 the display apparatus reproduces content to be displayed as a content image.

At operation 1020 the display apparatus identifies a category of content being reproduced. The identification of the category may for example be performed based on the metadata of the content.

At operation 1030 the display apparatus calls for tables corresponding to the plurality of categories, each table including the illumination levels which are obtained at the previous points in time at which no images are displayed and at which an image is displayed.

At operation 1040 the display apparatus selects the table corresponding to the identified category of the content.

At operation 1050 the display apparatus obtains the illumination level at the current point in time from the sensor.

At operation 1060 the display apparatus uses the selected table to identify the ambient brightness based on the obtained illumination level. The method of using the table to identify the ambient brightness is the same as described in a foregoing embodiment.

In this way, the table is selected and used corresponding to the standard image having the screen brightness similar to that of the currently reproduced content, and it is therefore possible for the display apparatus to more accurately identify the ambient brightness.

In the foregoing embodiment, the content is sorted into the categories corresponding to the genres or the screen brightness levels, and the plurality of tables are provided corresponding to the plurality of categories. Alternatively, the plurality of tables may be provided corresponding to other conditions of the content than the categories. Below, an embodiment in this respect will be described.

Figure 11:
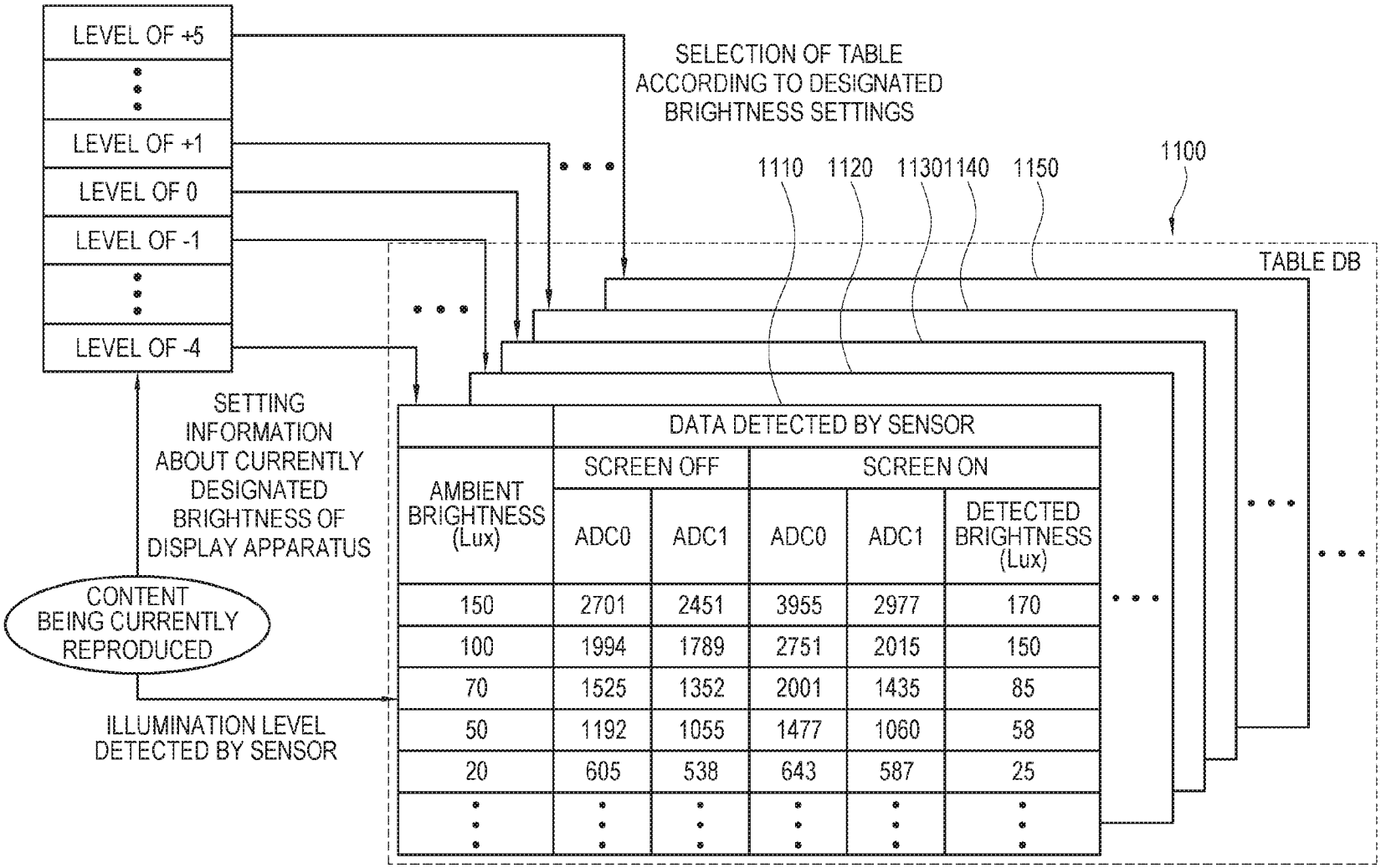
FIG. 11 illustrates an example of a principle that a display apparatus according to an embodiment identifies ambient brightness based on a table according to brightness settings designated by a user.

FIG. 11 illustrates an example of a principle that a display apparatus according to an embodiment identifies ambient brightness based on a table according to brightness settings designated by a user.

As shown in FIG. 11, the display apparatus includes a table DB 1100 including a plurality of tables 1110, 1120, 1130, 1140 and 1150. In this embodiment, the tables 1110, 1120, 1130, 1140 and 1150 are different in values from one another based on the intensity of the backlight unit or the screen brightness of the display apparatus designated by a user. The method of producing the tables 1110, 1120, 1130, 1140 and 1150 is similar to that of a foregoing embodiment, but reflects additional settings to make the tables 1110, 1120, 1130, 1140 and 1150 correspond to screen brightnesses that are different from one another.

The display apparatus obtains setting information about the screen brightness of the display apparatus designated by a user at a current point in time. For example, the screen brightness is divided into a total of ten levels from a '−4' level to a '+5' level. With respect to the basic setting of a '0' level, the screen brightness output from the display apparatus increases whenever the level becomes higher, but decreases whenever the level becomes lower.

The display apparatus selects one table corresponding to the obtained setting information among the plurality of tables 1110, 1120, 1130, 1140 and 1150. For example, the display apparatus selects the table 1130 corresponding to the '0' level when the '0' level is set as the screen brightness designated by a user at the current point in time, and selects the table 1150 corresponding to the '+5' level when the '+5' level is set.

The display apparatus employs one selected among the tables 1110, 1120, 1130, 1140 and 1150 to identify the ambient brightness corresponding to the illumination level detected by the sensor at the current point in time. The method of using the tables 1110, 1120, 1130, 1140 and 1150 to identify the ambient brightness is the same as described in a foregoing embodiment.

Figure 12:
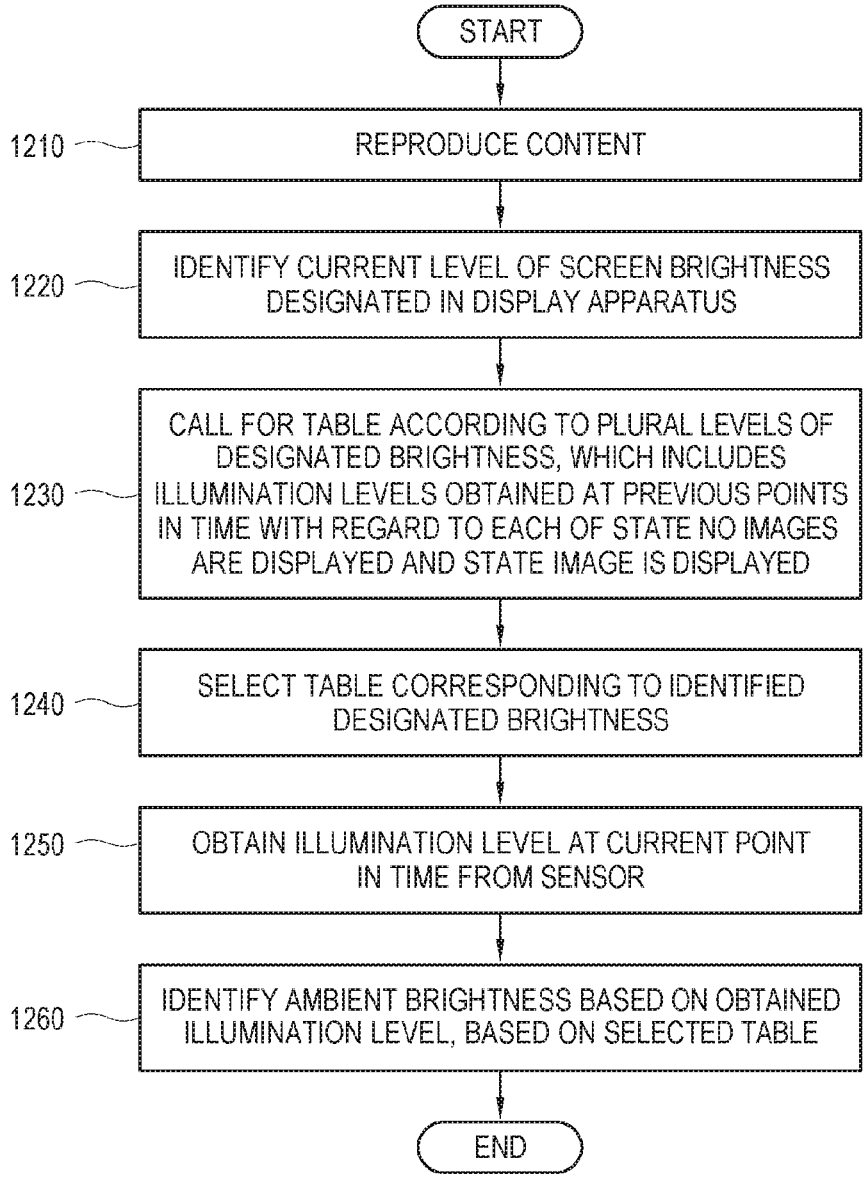
FIG. 12 is a flowchart showing a method by which a display apparatus according to an embodiment identifies ambient brightness based on a table according to brightness settings designated by a user.

FIG. 12 is a flowchart showing a method by which a display apparatus according to an embodiment identifies ambient brightness based on a table according to brightness settings designated by a user.

The embodiment shown in FIG. 12 may be implemented by the processor of the display apparatus.

At operation 1210 the display apparatus produces content to be displayed as the content image.

At operation 1220 the display apparatus checks the level of the screen brightness currently designated in the display apparatus.

At operation 1230 the display apparatus calls for tables according to a plurality of designated brightness levels, each table including the illumination levels which are obtained at the previous points in time at which no images are displayed and at which an image is displayed.

At operation 1240 the display apparatus selects the table corresponding to the checked designated brightness.

At operation 1250 the display apparatus obtains the illumination level of the current point in time from the sensor.

At operation 1260 the display apparatus uses the selected table to identify the ambient brightness based on the obtained illumination level. The method of using the table to identify the ambient brightness is the same as described in a foregoing embodiment.

In this way, the table corresponding to the screen brightness designated by a user is selected and used in the display apparatus, so that the display apparatus can more accurately identify the ambient brightness.

The display apparatus may operate differently from the foregoing embodiments as follows. The display apparatus obtains the illumination level at a time when no images are displayed and the illumination level at a time when an image is displayed, thereby determining the external light brightness and the screen brightness based on the obtained illumination levels. The display apparatus may compare a difference between the screen brightness and the external light brightness with a preset threshold value, and identify the ambient brightness by directly using the illumination level based on the time when no images are displayed when the value is lower than the threshold value, but identify the ambient brightness by the process of using the table like those of the foregoing embodiments when the value is higher than the threshold value.

This is because noise components caused by the screen brightness are negligible when the difference in value between the brightness caused by the external light and the screen brightness is relatively small. In this case, the display apparatus does not implement the process using the table like the foregoing embodiments, and thus reduces a system load due to the process.

The operations of the apparatus described in the foregoing embodiments may be performed by artificial intelligence provided in the corresponding apparatus. The artificial intelligence may be applied to various general systems by utilizing a machine learning algorithm. An artificial intelligence system refers to a computer system with intelligence of a human or being second to a human. In such a system, a machine, an apparatus or a system autonomously performs learning and identifying and is improved in accuracy of recognition and identification based on accumulated experiences. The artificial intelligence is based on elementary technology by utilizing machine learning (deep-running) technology and algorithms based on an algorithm of autonomously classifying and learning features of input data, and copying perception, identification and the like functions of a human brain.

The elementary technology may for example include at least one of language comprehension technology for recognizing a language and a text of a human, visual understanding technology for recognizing a thing like a human sense of vision, inference and prediction technology for identifying information and logically making inference and prediction, knowledge representation technology for processing experience information of a human into knowledge data, and motion control technology for controlling a vehicle's automatic driving or a robot's motion.

Here, language comprehension refers to technology of recognizing, applying and processing a human's language or text, and includes natural language processing, machine translation, conversation system, question and answer, voice recognition and synthesis, etc.

Inference and prediction refer to technology of identifying information and logically making prediction, and includes knowledge- and probability-based inference, optimized prediction, preference-based plan, recommendation, etc.

Knowledge representation refers to technology of automating a human's experience information into knowledge data, and includes knowledge building such as data creation and classification, knowledge management such as data utilization, etc.

The methods according to the foregoing embodiments may be achieved in the form of a program command that can be implemented in various computers, and recorded in a computer readable medium. Such a computer readable medium may include a program command, a data file, a data structure or the like, or combination thereof. For example, the computer readable medium may be stored in a volatile or nonvolatile storage such as a read only memory (ROM) or the like, regardless of whether it is deletable or rewritable, for example, a RAM, a memory chip, a device or integrated circuit (IC) or the like memory, or an optically or magnetically recordable or machine (e.g., a computer)-readable storage medium, for example, a compact disk (CD), a digital versatile disk (DVD), a magnetic disk, a magnetic tape or the like. It will be appreciated that a memory, which can be included in a mobile terminal, is an example of the machine-readable storage medium suitable for storing a program having instructions for realizing the embodiments. The program command recorded in this storage medium may be specially designed and configured according to the embodiments, or may be publicly known and available to those skilled in the art of computer software.

Although a few embodiments have been shown and described, it will be appreciated by those skilled in the art that changes may be made in these embodiments without departing from the principles and spirit of the disclosure, the scope of which is defined in the appended claims and their equivalents.

What is claimed is:

1. A display apparatus comprising:

a display;

an optical sensor; and a processor configured to:

obtain information about a plurality of first illumination levels and a plurality of second illumination levels respectively corresponding to the plurality of first illumination levels, wherein the plurality of first illumination levels is detected when the display is on in a first ambient illumination condition and the plurality of second illumination levels is detected when the display is off in the first ambient illumination condition;

in response to obtaining a current illumination value detected by the optical sensor while the display displays an image in a second ambient illumination condition different from the first ambient illumination condition, identify one of the plurality of first illumination levels corresponding to the current illumination value, and identify one of the plurality of second illumination levels in the information, the one of the plurality of second illumination levels corresponding to the identified first illumination level as an ambient brightness; and adjust a brightness of the display which displays the image, the adjusted brightness corresponding to the identified ambient brightness.

2. The display apparatus according to claim 1, further comprising a storage configured to store a table in which the plurality of first illumination levels and the plurality of second illumination levels are tabulated, wherein each first illumination level from among the plurality of first illumination levels and each second illumination level from among the plurality of second illumination levels corresponds to the first ambient illumination condition from among a plurality of illumination conditions, and wherein the processor identifies the first illumination level and the second illumination level based on the table stored in the storage.

3. The display apparatus according to claim 2, wherein the plurality of first illumination levels and the plurality of second illumination levels of the table are based on illumination values detected by the optical sensor.

4. The display apparatus according to claim 2, wherein the storage further is configured to store a plurality of tables, each table from among the plurality of tables corresponding to a respective image from among a plurality of images that are different in screen brightness, and the processor is further configured to identify the ambient brightness based on a table from among the plurality of tables which corresponds to the image displayed by the display.

5. The display apparatus according to claim 2, wherein the storage is further configured to store a plurality of tables, each table from among the plurality of tables corresponding to a respective screen brightness set to the display apparatus, and the processor is further configured to identify the ambient brightness based on a table from among the plurality of tables which corresponds to a currently set screen brightness.

6. The display apparatus according to claim 1, wherein the processor is further configured to identify, while content is being reproduced, a time during which no image is displayed on the display, and identify the ambient brightness based on an illumination value detected by the optical sensor during the identified time.

7. The display apparatus according to claim 6, wherein the processor is further configured to identify the time based on metadata of the content.

8. The display apparatus according to claim 1, wherein the processor is further configured to:

identify a first current illumination level when the display is off based on a first illumination value detected by the optical sensor;

identify a second current illumination level when the display is on based on a second illumination value detected by the optical sensor;

compare a first ambient brightness identified based on the first current illumination level with a second ambient brightness identified based on the second current illumination level;

identify the first ambient brightness as the ambient brightness based on the first ambient brightness being equal to the second ambient brightness; and identify a third ambient brightness as the ambient brightness based on the first ambient brightness not being equal to the second ambient brightness.

9. The display apparatus according to claim 8, wherein the processor is further configured to identify the third ambient brightness based on the first ambient brightness and the second ambient brightness.

10. A method of controlling a display apparatus, the method comprising:

obtaining information about a plurality of first illumination levels and a plurality of second illumination levels respectively corresponding to the plurality of first illumination levels, wherein the plurality of first illumination levels is detected when a display of the display apparatus is on in a first ambient illumination condition and the plurality of second illumination levels is detected when the display is off in the first ambient illumination condition;

in response to obtaining a current illumination value detected while the display displays an image in a second ambient illumination condition different from the first ambient illumination condition, identifying one of the plurality of first illumination levels corresponding to the current illumination value, and identifying one of the plurality of second illumination levels in the information, the one of the plurality of second illumination levels corresponding to the identified first illumination level as an ambient brightness; and adjusting a brightness of the display which displays the image, the adjusted brightness corresponding to the identified ambient brightness.

11. The method according to claim 10, further comprising:

storing, in a storage of the display apparatus, a table in which the plurality of first illumination levels and the plurality of second illumination levels are tabulated, wherein each first illumination level from among the plurality of first illumination levels and each second illumination level from among the plurality of second illumination levels corresponds to the first ambient illumination condition from among a plurality of illumination conditions, and wherein the first illumination level and the second illumination level are identified based on the table.

12. The method according to claim 11, wherein the plurality of first illumination levels and the plurality of second illumination levels of the table are based on illumination values detected by an optical sensor.

13. The method according to claim 11, further comprising:

storing, in the storage of the display apparatus, a plurality of tables, each table from among the plurality of tables corresponding to a respective image from among a plurality of images that are different in screen brightness; and identifying the ambient brightness based on a table from among the plurality of tables which corresponds to the image displayed by the display.

14. The method according to claim 11, further comprising:

storing, in the storage of the display apparatus, a plurality of tables, each table from among the plurality of tables corresponding to a respective screen brightness set to the display; and identifying the ambient brightness based on a table from among the plurality of tables which corresponds to a currently set screen brightness.

15. The method according to claim 10, further comprising:

while content is being reproduced, identifying a time during which no image is displayed on the display; and identifying the ambient brightness based on an illumination value detected by an optical sensor during the identified time.

16. The method according to claim 15, wherein the time is identified based on metadata of the content.

17. The method according to claim 10, further comprising:

identifying a first current illumination level when the display is off based on a first illumination value detected by an optical sensor;

identifying a second current illumination level when the display is on based on a second illumination value detected by the optical sensor;

comparing a first ambient brightness identified based on the first current illumination level with a second ambient brightness identified based on the second current illumination level;

identifying the first ambient brightness as the ambient brightness based on the first ambient brightness being equal to the second ambient brightness; and identifying a third ambient brightness as the ambient brightness based on the first ambient brightness not being equal to the second ambient brightness.

18. The method according to claim 17, wherein the third ambient brightness is determined based on the first ambient brightness and the second ambient brightness.

19. A method for identifying a current ambient brightness in an environment around a display apparatus, the method comprising:

obtaining information for a plurality of first illumination levels in association with a plurality of second illumination levels, wherein the plurality of first illumination levels is sensed at a time when the display apparatus is on in a first ambient illumination condition, and the plurality of second illumination levels is sensed at a time when the display apparatus is off in the first ambient illumination condition;

in response to obtaining a first current illumination value while the display apparatus displays an image in a second ambient illumination condition different from the first ambient illumination condition, identifying one of the plurality of first illumination levels corresponding to the first current illumination value and identifying one of the plurality of second illumination levels corresponding to the identified first illumination level as an ambient brightness, by searching the information; and adjusting a brightness of the display apparatus which displays the image, the adjusted brightness corresponding to the identified ambient brightness, wherein the identifying one of the plurality of second illumination levels comprises:

obtaining a second current illumination value when the display apparatus is off;

based on the second current illumination value being equal to the identified second illumination level, identifying the ambient brightness as the second current illumination value; and based on the second current illumination value not being equal to the identified second illumination level, identifying the ambient brightness as a value, which is an average of the second current illumination value and the identified second illumination level.

20. The method according to claim 19, further comprising:

preparing a plurality of preset images, each preset image from among the plurality of preset images corresponding to a different respective category of image content;

storing a plurality of tables, each table from among the plurality of tables including the plurality of first illumination levels that are sensed at a time when the display apparatus is displaying a different respective preset image;

identifying a current category of image content based on image data of the image;

selecting a table from among the plurality of tables that is stored using a preset image from among the plurality of preset images that corresponds to a category of image content that is equal to the current category of image content; and using the selected table to identify the ambient brightness.

21. The method according to claim 19, further comprising:

preparing a plurality of preset images, each preset image from among the plurality of preset images having a different respective screen brightness;

storing a plurality of tables, each table from among the plurality of tables including the plurality of first illumination levels that are sensed at a time when the display apparatus is displaying a different respective preset image;

identifying a current screen brightness based on image data of the image;

selecting a table from among the plurality of tables that is stored using a preset image from among the plurality of preset images that has a screen brightness equal to the current screen brightness; and using the selected table to identify the ambient brightness.

* * * * *